US005335773A

United States Patent [19]

Haber et al.

[11] Patent Number: 5,335,773

[45] Date of Patent: Aug. 9, 1994

[54] MULTI-PHARMACEUTICAL STORAGE, MIXING AND DISPENSING VIAL

[75] Inventors: Terry M. Haber, Lake Forest; William H. Smedley, Lake Elsinore; Clark B. Foster, Laguna Niguel, all of Calif.

[73] Assignee: Hably Medical Technology Corporation, Laguna Hills, Calif.

[21] Appl. No.: 87,152

[22] Filed: Jul. 2, 1993

[51] Int. Cl.[5] ..... B65D 25/08

[52] U.S. Cl. ..... 206/221; 206/219; 215/DIG. 8; 604/203

[58] Field of Search ..... 206/63.5, 219, 221; 215/DIG. 8; 604/87, 89, 203, 416; 222/52, 386, 522, 523; 366/128, 130

[56] References Cited

U.S. PATENT DOCUMENTS

| | | | |
|---|---|---|---|
| 2,764,156 | 9/1956 | Simon et al. | 206/221 |
| 2,764,157 | 9/1956 | Oliva et al. | 206/221 |
| 3,139,180 | 6/1964 | Kobernick | 206/221 |
| 3,139,181 | 6/1964 | Kobernick | 206/63.5 |
| 3,156,369 | 11/1964 | Bowes et al. | 215/DIG. 8 |
| 3,163,163 | 12/1964 | Wilburn | 206/221 |
| 3,189,194 | 8/1965 | Wilburn | 206/221 |
| 3,464,414 | 9/1969 | Sponnoble | 604/416 |
| 3,539,794 | 11/1970 | McKay Rauhut et al. | 206/221 |
| 3,779,371 | 12/1973 | Rovinski | 206/221 |
| 3,842,836 | 10/1974 | Ogle | 206/221 |
| 4,315,570 | 2/1982 | Silver et al. | 206/221 |
| 4,936,446 | 6/1990 | Lataix | 206/221 |
| 4,941,876 | 7/1990 | Meyer et al. | 206/221 |
| 5,114,411 | 5/1992 | Haber et al. | 604/87 |
| 5,143,211 | 9/1992 | Miczka et al. | 206/219 |
| 5,158,546 | 10/1992 | Haber et al. | 604/87 |
| 5,188,615 | 2/1993 | Haber et al. | 604/87 |
| 5,217,433 | 6/1993 | Bunin | 206/221 |
| 5,220,948 | 6/1993 | Haber et al. | 604/416 |

*Primary Examiner*—David T. Fidei
*Attorney, Agent, or Firm*—Townsend and Townsend Khourie and Crew

[57] ABSTRACT

A pharmaceutical storage, mixing and dispensing vial (2) is used to store first and second pharmaceuticals (58, 60), mix the pharmaceuticals, and then provide access to the mixed pharmaceutical (102) via a needle canula. The vial includes a container (12) having an open end (14) covered by a convex septum (40). A barrier (37) within the container interior (52) divides the interior into first and second interior regions (54, 56) housing the pharmaceuticals. The barrier has a plug (34) sealing a hole (30) the plug having an extension (36) extending to the septum. The plug is driven from the opening by the plug extension when the septum is deflected into the container interior. The septum then naturally returns to its undeflected state to eliminate pressurization of the container interior.

19 Claims, 6 Drawing Sheets

MULTI-PHARMACEUTICAL STORAGE, MIXING AND DISPENSING VIAL

This application is related to the following: U.S. Pat. No. 5,188,615 issued Feb. 23, 1993 for MIXING VIAL and U.S. Pat. No. 5,158,546 issued Oct. 27, 1992 for CONTROLLED ACTION SELF-MIXING VIAL, the disclosures of each being incorporated by reference.

BACKGROUND OF THE INVENTION

Safe and effective drug therapy by injection depends not only upon accurate diagnosis, but also on efficient and reliable introduction of the medical substance into the subcutaneous cellular tissue without introducing contaminants or ambient air. The applicable drug or pharmaceutical must first be drawn from the resident container or vial into a syringe before injection. The integrity and features of the vial, therefore, are influential over the overall safety of the injection.

Problems associated with injections are complicated when the medication to be administered must be stored as two separate component parts, then mixed, prior to injection. Dual chamber vials have been developed to facilitate storage and mixing of these two-component medications. Common examples of multipart medications include medications which must be mixed from a component A, usually a preservative or catalyst, and a component B, which is usually a pharmaceutical. Component A or component B may be in powder or crystalline form instead of liquid form.

Dual chamber vials have been developed which allow an A component and a B component to remain separated in independent chambers within a single package until mixing is desired. The vial allows mixing of the component parts in that same unitary package. In an example of such a device is the MIX-O-VIAL two compartment vial manufactured by the Upjohn Company of Kalamazoo, Mich. This device is a single vial container having two chambers separated by a small stopper. The septum is formed by a stopper-piston slidably mounted within the vial at one end. The stopper-piston is forced into the vial to pressurize the chamber between the stopper-piston and the plug doing so displaces a plug lodged in a small orifice separating the two chambers. The displaced plug floats freely in the other chamber and is used as an agitator to mix the two component parts together. The two components are free to flow between chambers through the connecting orifice and thereby mix together. Although this device has proven quite useful, it has its disadvantages.

While in many cases having an over-pressure (as is produced in the MIX-O-VIAL) existing within a vial is not a problem, if the pharmaceuticals are in the form of cytotoxins used for chemotherapy, over-pressure within the vial could create safety problems. It is quite possible that upon accessing the vial, a quantity of the cytotoxin could be accidentally released onto the skin of a health care worker. Cytotoxins are quite dangerous in this concentrated form and are capable of destroying tissue they come in contact with.

Pharmaceutical components are sometimes sensitive to how violently they are mixed. For example, certain lyophilized crystals of human growth hormone, when mixed with a liquid carrier, must be mixed slowly. Mixing too quickly can cause damage to the pharmaceutical. The mechanical crushing, shearing and tearing which can accompany rapid mixing caused by a loose solid agitator, can break up the molecules into subcomponents which do not retain the same medical qualities.

SUMMARY OF THE INVENTION

The present invention is directed to a pharmaceutical vial used to store first and second pharmaceutical components in separate regions, mix the pharmaceutical components and withdraw the mixed pharmaceutical through a needle canula. The invention is simple in construction and is designed so that the mixed pharmaceutical is not subjected to an over-pressure within the interior of the container when accessed by the needle cannula to effectively eliminate the problems associated with having a pharmaceutical-containing vial at an over-pressure.

The vial includes a container having an open end, a needle pierceable access member, preferably in the form of a convex septum, which covers the open end of the container to create a sealed interior therein. A barrier is fixed in place within the interior of the container and divides the interior into first and second interior regions housing the first and second pharmaceutical components. The barrier is capable of being breached when at least a portion of the access member is driven into the container interior. This breaching preferably occurs by shifting a plug in the barrier thus providing fluid access between the interior regions. The plug is preferably mechanically driven, from its sealed position to its open position, by virtue of the access member pushing on a relatively rigid extension of the plug.

There are two main aspects to the invention. With the first aspect, the access member is secured to the open end of the container so that the access member can enter the container interior but does not slide within the container. The access member is designed so that after being forced into the container interior, the access member returns to its original position so to eliminate any overpressure in the container. The access member is preferably in the form of a resilient, outwardly bowed or convex septum; it could have another shape, such as flat, as well.

A second aspect of the invention relates to the use of a movable access member, which can either be a septum, as with the first type, or a piston, but which is mechanically (as opposed to pneumatically or hydraulically) coupled to the barrier so that the movement of the access member, as opposed to increased pressure in the vial interior, causes the barrier to be breached.

One of the advantages of the invention is that by using an access member, typically a septum, which returns to its original, pre-deflected state after being deflected causing the barrier to breached, pressurization within the container interior when accessed by a needle cannula is eliminated. This is very important in dealing with cytotoxins as the mixed pharmaceutical.

Another feature of the invention is the provision of a protective cap used to cover the septum until mixing has taken place. After mixing the pharmaceutical components, the cap automatically pops open, thus exposing the septum. This not only helps protect the septum from contamination, it also prevents premature access to the interior of the container. This is important to prevent access to the contents before mixing so to prevent the unintended or unauthorized introduction of a foreign substance into the vial or removal of some of the contents from the vial prior to mixing.

Other features and advantages of the invention will appear from the following description in which the preferred embodiment has been set forth in detail in conjunction with the accompanying drawings.

DESCRIPTION OF THE PREFERRED EMBODIMENT

Figure 1:
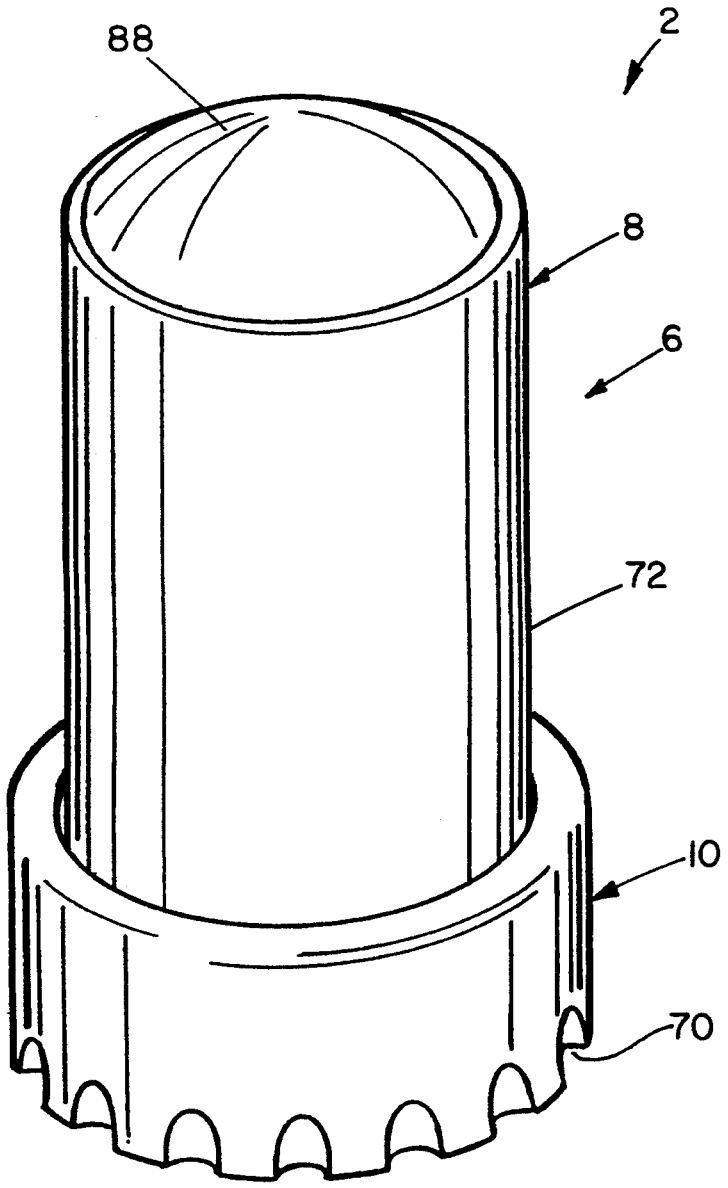
FIG. 1 is an isometric view of a vial made according to the invention.
Figure 2:
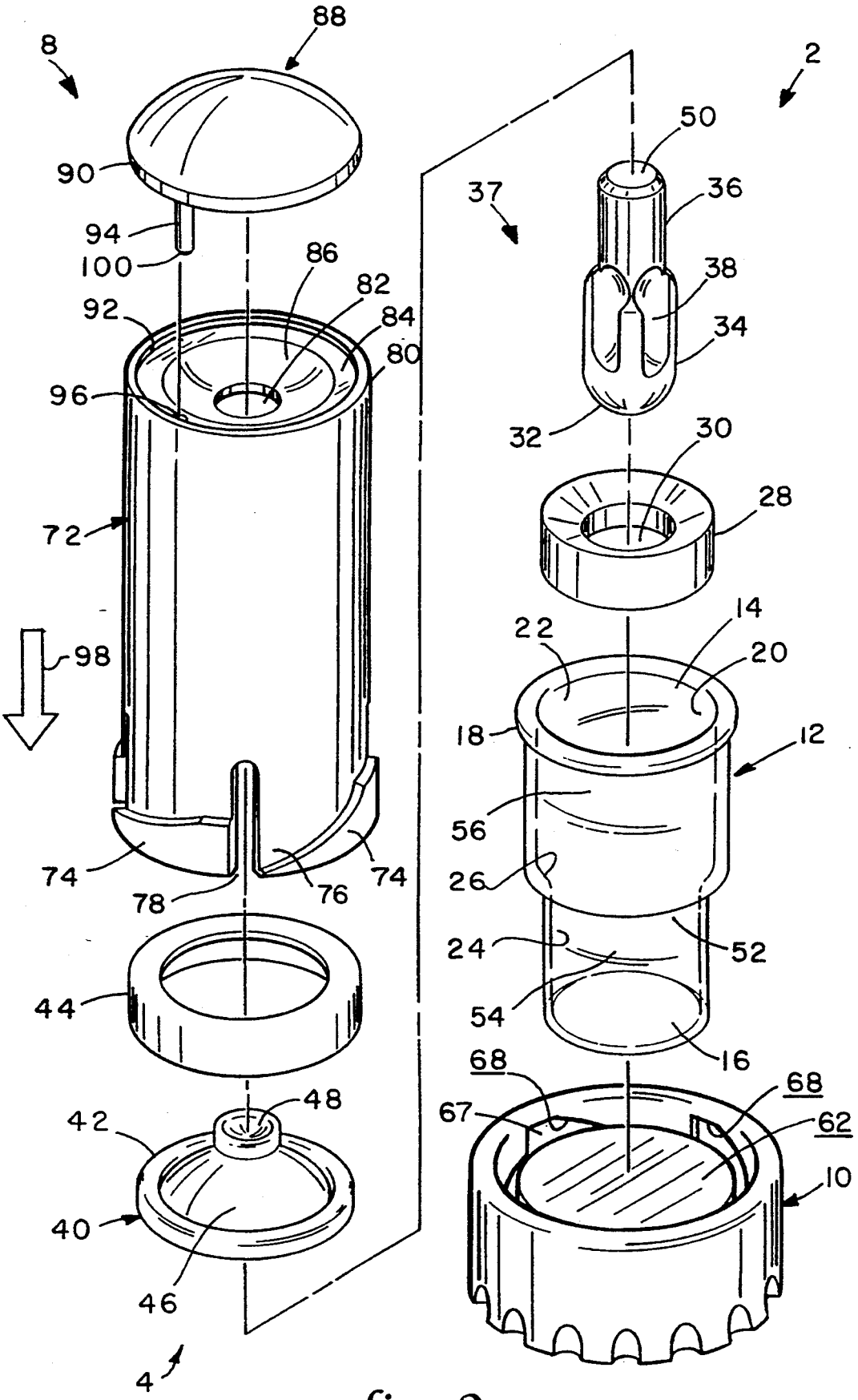
FIG. 2 is an exploded isometric view of the vial of FIG. 1.
Figure 3:
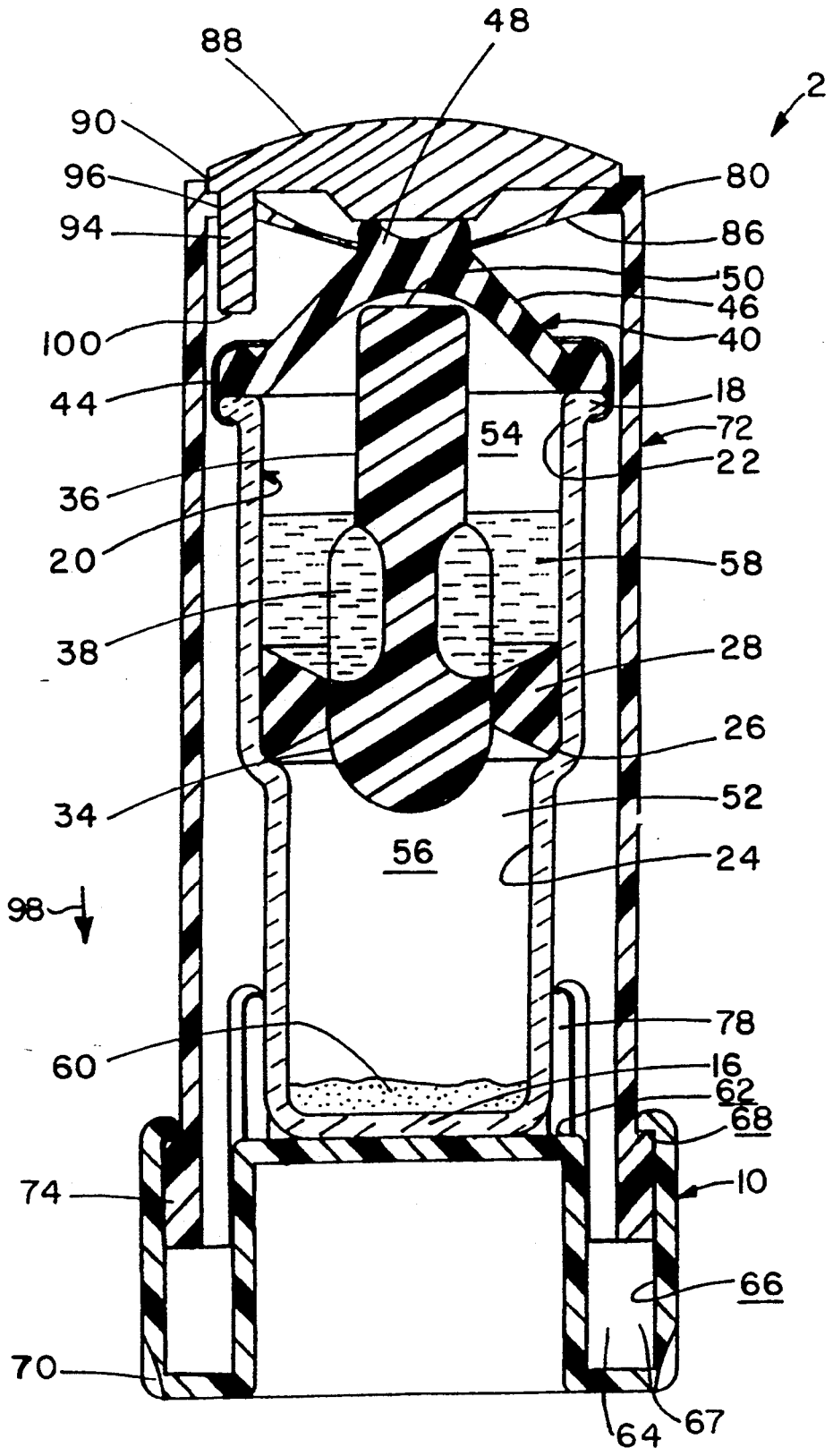
FIG. 3 is a cross-sectional view of the vial of FIG. 1 shown in the pre-use condition.

FIGS. 1–3 illustrate a multi-pharmaceutical storage, mixing and dispensing vial 2 including a container assembly 4 housed within a housing 6. Housing 6 includes a generally cylindrical, hollow cap assembly 8 rotatably mounted to a base 10.

Container assembly 4 includes a cup-shaped container 12, preferably made of glass, having an open end 14 and a closed end 16. Open end 14 has a lip 18. Container 12 has an inner wall 20 defining an upper cylindrical wall portion 22 and a lower cylindrical wall portion 24. Wall portion 22 is a somewhat larger diameter than wall portion 24, the two wall portions being joined at a ledge 26. An elastomeric seal ring 28 is positioned snugly against upper cylindrical wall portion adjacent ledge 26. Seal ring 28 is made from a pharmaceutical compatible material, such as 50 Durometer silicone rubber. Elastomeric seal ring 28 has a central hole 30 in which the distal end 32 and of a plug 34 is lodged.

In the as-shipped, pre-use condition of FIGS. 1 and 3, plug 34 and seal ring 28 act as a fluid seal or barrier 37 in container 12. Fluid passage through hole 30 is provided by pushing on an extension 36 of plug 34 so to overlap axial slots 38 with hole 30. In this position, plug 34 is still retained within seal ring 28, but fluid passage through hole 30 is achieved. Plug 34/extension 36 is made from a lubricous material, to minimize friction within hole 30, such as PTFE. This movement of plug extension 36 and plug 34 is discussed below.

Container assembly 4 also includes an elastomeric convex septum 40 having a periphery 42 that engages open end 14 and around lip 18 of container 12. Septum 42 is made from a pharmaceutical compatible material, such as 60 Durometer silicone rubber. Septurn 42 is secured in place by a metal, preferably aluminum, retaining band 44. Septum 40 has a convex central portion 46 and a needle-pierceable region 48 at the center of central portion 46. Portion 48 is slightly dished to help in the insertion of a needle cannula, not shown, through septurn 40 at portion 48.

Septum 40 and inner wall 20 define a sealed interior 52 of container assembly 4. Barrier 37 separates sealed interior 52 into a first or upper interior region 54 between septum 40 and barrier 37 and a second or lower interior region 56 defined between barrier 37 and closed end 16 of container 12. First and second pharmaceutical components 58, 60 are housed within first and second interior regions 54, 56, respectively. In the disclosed embodiment, first pharmaceutical component is a liquid and second pharmaceutical component is dry. However, both pharmaceutical components could be liquids, the dry pharmaceutical component could be a slurry and the locations of the liquid and dry pharmaceutical components in the first and second housings could be reversed.

Dry pharmaceutical component 60 is an lyophilized pharmaceutical component. Container 12 could be used to create the lyophilized component. This is done by adding an appropriate amount of a liquid or slurry pharmaceutical component used to create second, dry component 60. The container 12 is then placed in the lyophilization oven and the volatile components are driven off until a suitably dried second pharmaceutical component 60 is achieved. Container assembly 4 can then be assembled, adding first pharmaceutical component 58 to first interior region 54 after installing barrier 37 and just prior to sealing open end 14 with septum 40 and retaining band 44.

Figure 3A:
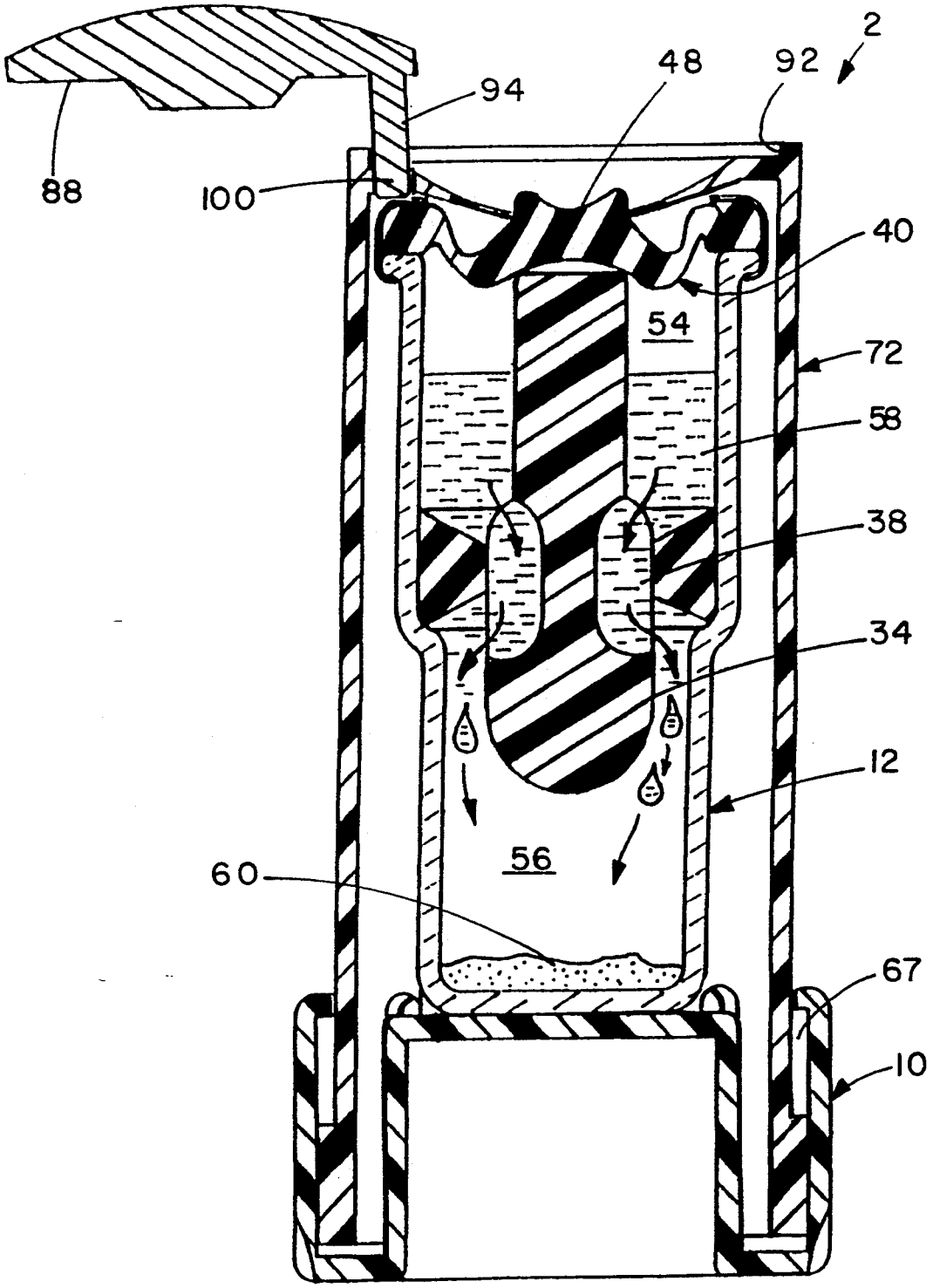
FIG. 3A is a view similar to FIG. 3 but after the housing has been collapsed to move the septum to its second, deflected position, the needle cannula shield has been pivoted to expose the needle pierceable portion of the septum and the plug has been moved to its unsealed position to permit the pharmaceutical components to mix.

A user could, if desired, dislodge plug 34 from hole 30 by simply pressing on needle-pierceable portion 48 of septum 40. This would drive plug extension 36 and thus plug 34 away from convex septum 40 until axial slots 38 are aligned with hole 30. This alignment, as shown in FIG. 3A, permits the liquid first pharmaceutical component 58 to flow into second interior region 56 and mix with second pharmaceutical component 60. Due in part to the natural resilience of septum 40, septum 40 returns to its normal, convex shape, see FIG. 3B, once released by the user. Once components 58, 60 are suitably mixed, user can then invert container assembly 4 and access the interior 52 using a needle cannula of a syringe to pierce portion 48 of septurn 40 in a conventional manner. Since septum 40 returns to its pre-use condition, an overpressure within sealed interior 52 is eliminated.

Housing 6 is used for several purposes. It provides a physical protection to container 12, helping to protect the container against physical damage. Housing 6 also covers and thus provides a needle cannula shield to prevent the premature access by a needle cannula into sealed interior 52 prior to mixing. Housing 6 also provides a mechanical advantage for the user in driving plug 34 partly through hole 30 of seal ring 28.

Base 10, typically polycarbonate, includes a support surface 62 against which closed end 16 of container 12 rests. Support surface 62 is surrounded by an annular space 64. An outer surface 66 of base 10 partly defines annular space 64. Surface 66 has a number of openings 67 partly bounded by cam ramped surfaces 68 formed in outer surface 66 and used for purposes described below. Base 10 also has numerous cut-outs 70 along its lower edge to enhance gripping by the user.

Cap assembly 8 includes a generally cylindrical upper housing 72, also typically made of polycarbonate, having externally extending ramped camming lugs 74 configured to fit within openings 67 in outer surface 66. A number of axially extending slots 78 are formed at lower end 76 of housing 72 to facilitate assembly. Slots 78 permit lower end 76 to be deflected inwardly when inserting lower end 76 into annular space 64 and then permit segments of the lower end defined between slots 78 to spring outwardly with ramped camming lug 74 engaged within openings 67 formed in surface 66.

The upper end 80 of upper housing 72 is closed except for a central opening 82 sized and positioned to accept needle pierceable portion 48 of septum 40. Upper end 80 includes a ledge 84 and a slightly concave portion 86 within which central opening 82 is formed. Cap assembly 8 also includes a needle cannula shield 88 which is made of a material resistant to puncture by a needle cannula, typically aluminum. Shield 88 has a periphery 90 sized to fit snugly, but not with a force fit, against a circumferential shoulder 92 adjacent ledge 84.

Shield 88 includes a pin 94 extending downwardly through a corresponding hole 96 in ledge 84. Twisting the two components of housing 6, that is cap assembly 8 and base 10, relative to one another, causes upper housing 72 to move downwardly, that is in the direction of arrow 98 in FIG. 3, relative to base 10 through the engagement of lugs 74 with ramped surfaces 68. This action forces convex central portion 46 of septum 40 in the direction of arrow 98 primarily due to the engagement of concave portion 86 of upper end 80 of upper housing 72. Such axial movement almost immediately causes portion 46 of septum 40 to engage the upper end 50 of plug extension 36, thus forcing plug 34 in the direction of arrow 98. This movement causes that portion of plug 34 containing axial slots 38 to be captured within hole 30 of ring 28, thus permitting first pharmaceutical component 58 to now drain down into and mix with second pharmaceutical component 60 through the now breached barrier 37. See FIG. 3A.

Figure 3B:
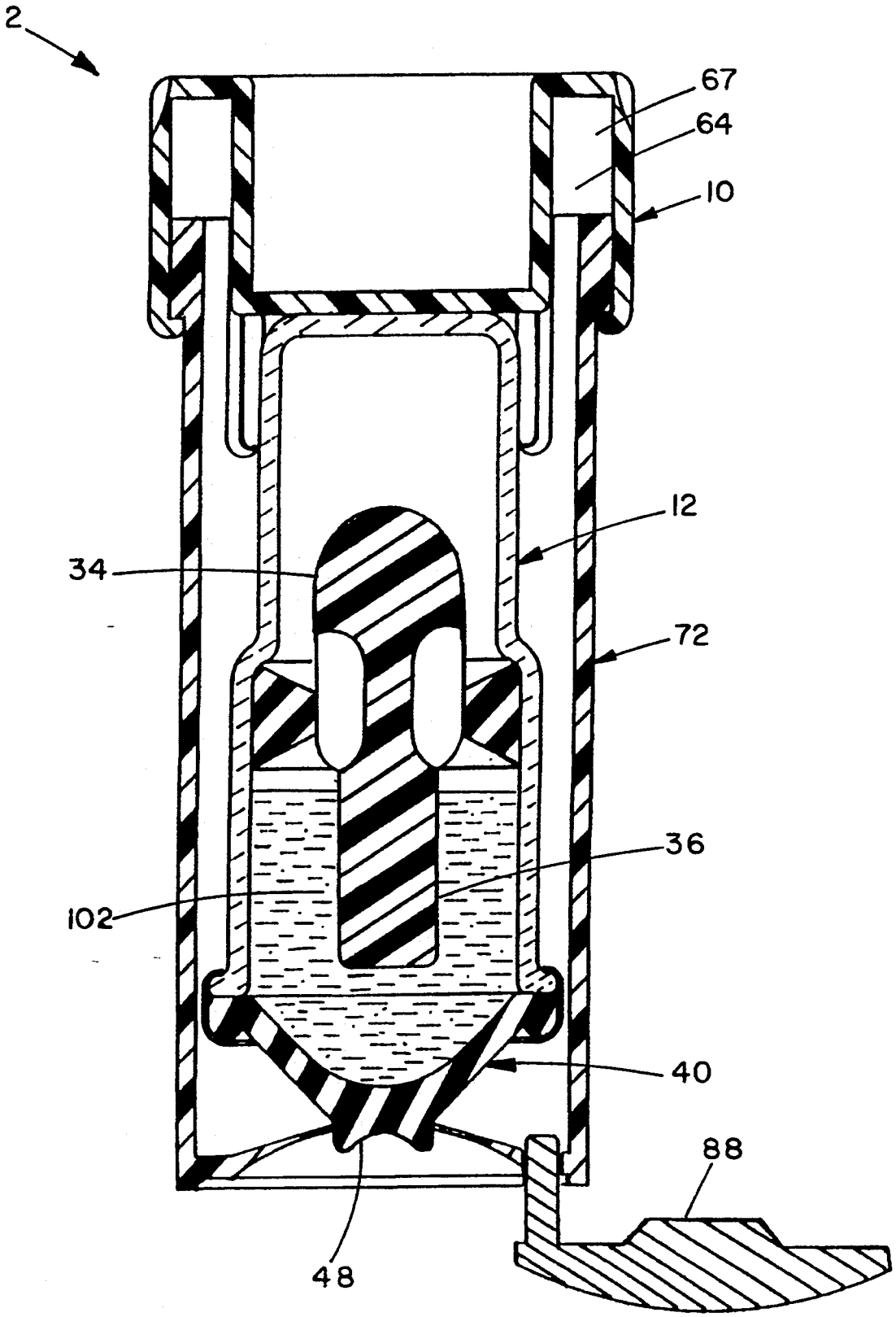
FIG. 3B is a view similar to that of FIG. 3A but inverted and with the septum returned to its first, undeflected position.

Movement of cap assembly 8 in the direction of arrow 98 also causes distal end 100 of pin 94 to engage retaining band 44 of container assembly 4, thus forcing pin 94 through hole 96. The initial movement pin 94 within hole 96 is relatively unrestricted by the pin in the hole; the pin, over most of its length, is undersized relative to the hole. However, the distal end 100 of pin 94 is slightly larger to create a snug fit of pin 94 within hole 96. Thus, as base 10 and upper housing 72 are rotated relative to one another, thus driving upper housing 72 in the direction of arrow 98 relative to base 10, while holding vial 2 at an angle to the vertical, causes shield 88 to swing out of the way, thus uncovering needle-pierceable portion 48 of septum 40 during the initial portion of the movement. At the end of the movement of upper housing 72 relative to base 10, the enlarged distal end 100 of pin 94 becomes snugly engaged within hole 96 so to maintain shield 88 in this septum-exposed position as shown in FIG. 3B.

The nesting of periphery 90 of shield 88 within an annular region defined by shoulder 92 and ledge 84 helps prevent inadvertent or premature removal of shield 88. However, after vial 2 has been activated by rotating base 10 relative to upper housing 72, portion 48 of septum 40 is very accessible for cleaning, such as by swabbing with alcohol, and for access by a needle cannula into sealed interior 52 for access to mixed pharmaceutical 102.

In use, a vial 2 is provided with first and second pharmaceutical components 58, 60 within interior regions 54, 56, such as a human growth hormone or a cytotoxin. To mix the pharmaceutical components, user rotates base 10 relative to upper housing 72 causing upper housing to move in the direction of arrow 98 relative to base 10. This forces concave portion 86 against convex central portion 46 of septum 40, thus driving plug 34 in the direction of arrow 98 and opening up fluid passageways between regions 54, 56 along slots 38. The movement of upper housing 72 towards base 10 also pops away shield 88, thus exposing needle-pierceable portion 48 of septum 40. With needle shield 88 pivoted out of the way, user can clean portion 48, invert vial 2, pass a needle cannula through portion 48 of septum 40 and withdraw the desired amount of the mixed pharmaceutical 102.

Figure 4:
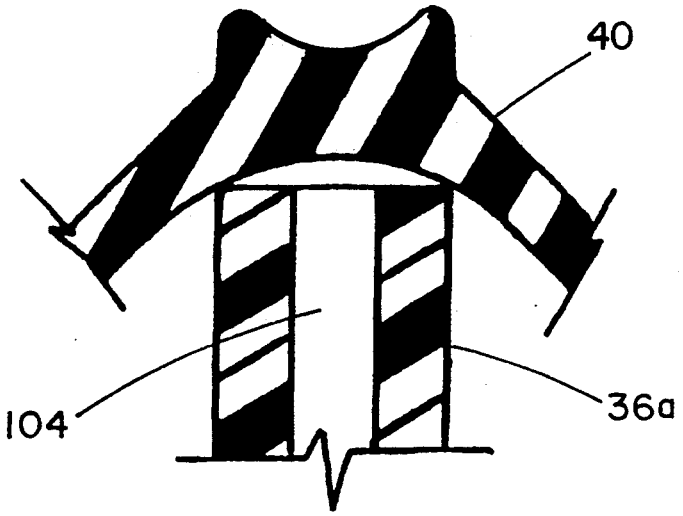
FIG. 4 is a cross-sectional view showing the hollow interior of an alternative embodiment of the plug extension of FIG. 3.

As shown in FIG. 4, plug extension 36*a* could have a hollow interior 104 and could be sized to normally rest against septum 40 when in the pre-use condition of FIGS. 1 and 3 so that the interior is isolated from the first region 54. This permits hollow interior 104 of plug extension 36*a* to house a third pharmaceutical component which would mix with the first and second pharmaceutical components 58, 60, when the vial is inverted as shown in FIG. 3B for a two-component pharmaceutical. The third pharmaceutical will flow out of the interior 104 and mix with the first and second components 58, 60.

Barrier 37 has been shown as including elastomeric seal ring 28 and plug 34. Other types of rupturable barriers can be used as well. A thin, taut elastomeric diaphragm could be used as a barrier with an axial extension of the septum extending towards the barrier with the tip of the extension positioned a short distance from the taut membrane. The tip of the septum extension could be sharpened so that, when it touches the taut membrane, the membrane ruptures providing a large opening between the two interior regions with little force and little movement. Also, a solid, brittle barrier with a notched or weakened region could be used; when the tip of a septum extension or some other mechanical coupler pushes against the brittle barrier, the barrier breaks, opening a pathway between the interior regions.

Figure 5:
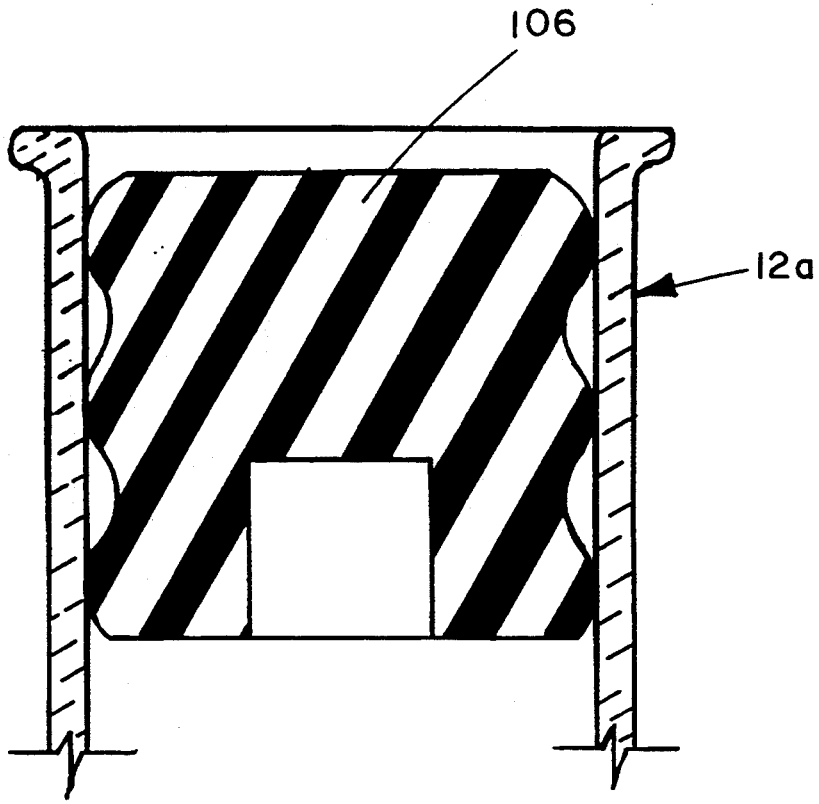
FIG. 5 is a cross-sectional view of the open end of an alternative embodiment of the container assembly of FIG. 3 using a slidable piston instead of a convex septum.

The present invention provides a significant advantage by using convex septum 40; after mixing, any overpressure in septum 52 is eliminated since the septum returns to its premixed condition. However, the invention could be used with an axially moveable piston 106 in place of the septum. See FIG. 5. The piston would be mechanically coupled to a barrier so that only a small movement of the piston would cause the barrier to breached. Thus, rather than relying on a pneumatic pressure increase created by movement of the piston, the distance the piston must move can be minimized and still cause the rupture or other breach of the barrier so that only a small overpressure may be created. Also, in appropriate circumstances, the septum could be a flat septum which returns to its original flat configuration after the barrier has been breached. This may, however, dictate a relatively short distance of movement by the septum to create a breached barrier.

Other modifications and variations can be made to the disclosed embodiments without deviating from the subject of the invention as defined in the following claims.

What is claimed is:

1. A pharmaceutical storage, mixing and dispensing vial, for storing first and second pharmaceutical components, mixing the pharmaceutical components and then providing access to the mixed pharmaceutical by a needle cannula, at least one of the first and second pharmaceutical components being a liquid component, the vial comprising:

a container having an inner wall and an open end;

a needle-pierceable access member having an outer region secured to the open end of the container so to create a sealed interior defined by the inner wall and the access member, said access member being deflectable inwardly into said interior from a first position to a second position;

a barrier within said interior separating said interior into first and second interior regions housing the first and second pharmaceutical components, respectively;

means for breaching the barrier so to fluidly couple the first and second interior regions upon movement of the access member from the first position to the second position so that the first and second pharmaceutical components mix to create the mixed pharmaceutical; and a needle cannula shield movable from a storage position to a working position, the needle cannula shield covering the access member in the storage position and exposing at least a portion of the access member in the working position, the needle cannula shield being movable from the working position to the storage position.

2. The vial of claim 1 wherein the container is a glass container.

3. The vial of claim 1 wherein the access member is an elastomeric septum.

4. The vial of claim 1 wherein the access member is convex.

5. The vial of claim 1 wherein the access member is a resilient access member which naturally assumes the first position.

6. The vial of claim 1 wherein the barrier includes an elastomeric seal ring positioned at a fixed location against the inner wall and defining a central opening.

7. The vial of claim 6 wherein the barrier includes a plug removably positioned with the central opening for movement between sealed and unsealed positions.

8. The vial of claim 7 wherein the plug is made of a lubricous plastic material.

9. The vial of claim 7 wherein the barrier breaching means includes a mechanical element physically coupling the access member and the plug configured so that movement of the access member from the first position to the second position moves the plug from the sealed position to the unsealed position thereby fluidly coupling the first and second interior regions.

10. The vial of claim 7 wherein the plug remains mounted within the central opening at both the sealed and unsealed positions.

11. A pharmaceutical storage, mixing and dispensing vial, for storing first and second pharmaceutical components, mixing the pharmaceutical components and then providing access to the mixed pharmaceutical by a needle cannula, at least one of the first and second pharmaceutical components being a liquid component, the vial comprising:

a container having an inner wall and an open end;

a needle-pierceable access member having an outer region secured to the open end of the container so to create a sealed interior defined by the inner wall and the access member, said access member being deflectable inwardly into said interior from a first position to a second position;

a barrier within said interior defining said interior into first and second interior regions housing the first and second pharmaceutical components;

means for breaching the barrier so to fluidly couple the first and second interior regions upon movement of the access member from the first position to the second position so the first and second pharmaceutical components mix to create the mixed pharmaceutical, the barrier breaching means including a mechanical element physically coupling the access member and the barrier, the physical element including a hollow interior housing a third pharmaceutical component; and means for fluidly coupling the third pharmaceutical component with the first and second pharmaceutical components to create a second mixed pharmaceutical upon movement of the access member from the first position to the second position.

12. The vial of claim 1 further comprising: a housing movably coupled to the container from a first axial position to a second axial position, the housing having an access member engagement element configured to engage the access member so that movement of the housing from the first axial position to the second axial position moves the access member from the first position to the second position.

13. A pharmaceutical storage, mixing and dispensing vial, for storing first and second pharmaceutical components, mixing the pharmaceutical components and then providing access to the mixed pharmaceutical by a needle cannula, at least one of the first and second pharmaceutical components being a liquid component, the vial comprising:

a container having an inner wall and an open end;

a needle-pierceable access member having an outer region secured to the open end of the container so to create a sealed interior defined by the inner wall and the access member, said access member being deflectable inwardly into said interior from a first position to a second position;

a barrier within said interior defining said interior into first and second interior regions housing the first and second pharmaceutical components; and means for breaching the barrier so to fluidly couple the first and second interior regions upon movement of the access member from the first position to the second position so the first and second pharmaceutical components mix to create the mixed pharmaceutical;

a cap mounted over the upper end of the container and covering the access member, the cap being movably mounted over the upper end of the container, for movement between first and second axial positions corresponding to the first and second positions of the access member, so to shield the access member when in the first axial position, the cap including an axial drive element, the cap being rotatably mounted over the upper end of the container for movement between the first and second axial positions, the cap including a needle cannula shield overlying the access member; and means for moving the needle cannula shield away from the access member, so to expose the access member to a needle cannula, when the cap is moved from the first axial position to the second axial position; and a housing;

wherein the needle cannula shield includes a pin sized to engage the housing as the cap moves towards the second axial position.

14. The vial of claim 12 further comprising: a lower housing, the housing and the lower housing substantially enclosing the container.

15. The vial of claim 14 wherein the housing and lower housing include mating cam sections which drive the cap between the first and second axial positions.

16. The vial of claim 1 further comprising means for moving the access member back to the first position, whereby any pressurization produced within said interior by the movement of the access member from the first position to the second position is eliminated.

17. A pharmaceutical storage, mixing and dispensing vial, for storing first and second pharmaceutical components, mixing the pharmaceutical components and providing access to the mixed pharmaceutical by a needle cannula, at least one of the first and second pharmaceutical components being a liquid component, the vial comprising:

a container having an inner wall and an open end;

a needle-pierceable seal movably mounted to the container at the open end so to seal the open end, the inner wall and the seal defining an interior, at least a portion of the seal being movable into the interior from a first position to a second position;

a barrier with the interior separating the interior into first and second interior regions housing the first and second pharmaceutical components, respectively;

means for breaching the barrier so to fluidly couple the first and second interior regions upon movement of the seal from the first position to the second position, the barrier breaching means including means for mechanically coupling the seal and the barrier; and a housing movably coupled to the container between a first axial position and a second axial position, the housing including a seal engagement element configured to engage the seal, the seal engagement element engaging the seal so that the seal moves from the first position to the second position when the housing moves from the first axial position to the second axial position.

18. The vial of claim 17 wherein the seal includes a normally convex, resilient, elastomeric septum secured to the open end of the container, a central portion of said septum being said portion of the seal movable into the interior.

19. The vial of claim 17 wherein the seal includes an elastomeric piston slidably mounted to the container.

* * * * *